US005864266A

United States Patent [19]

Mickelson et al.

[11] Patent Number: 5,864,266

[45] Date of Patent: Jan. 26, 1999

[54] REVERSE DEFLECTION PREVENTION ARRANGEMENT FOR A BIMETAL IN A CIRCUIT BREAKER

[75] Inventors: Scott A. Mickelson, North Liberty; Randall L. Siebels, Cedar Rapids; Eugene W. Wehr, Cedar Rapids; Ardean G. Schill, Cedar Rapids, all of Iowa

[73] Assignee: Square D Company, Palatine, Ill.

[21] Appl. No.: 992,978

[22] Filed: Dec. 18, 1997

[51] Int. Cl.[6] ..... H01H 75/12

[52] U.S. Cl. ..... 335/35; 335/167; 335/23; 335/202

[58] Field of Search ..... 335/23.5, 35–37, 335/167–176, 202

[56] References Cited

U.S. PATENT DOCUMENTS 3,162,739 12/1964 Klein et al. ..... 335/35

3,487,343 12/1969 Myers et al. ..... 335/35

4,156,219 5/1979 Coleman ..... 335/175

*Primary Examiner*—Lincoln Donovan

*Attorney, Agent, or Firm*—Larry I. Golden; Kareem M. Irfan

[57] ABSTRACT

A reverse deflection prevention arrangement is provided for use in a circuit breaker for preventing a bimetal from bending in a direction opposite its normal thermal deflection. The reverse deflection prevention arrangement includes a tab portion extending from a yoke and a corresponding block member disposed on the inside surface of a circuit breaker cover. The tab portion engages the block member when the bimetal is forced to deflect in the direction opposite its normal deflection. An alternate embodiment of the reverse deflection prevention arrangement includes a reinforcement member secured to one end of the bimetal. The reinforcement member strengthens and supports the bimetal so that it is prevented from bending in the direction opposite its normal thermal deflection.

7 Claims, 5 Drawing Sheets

REVERSE DEFLECTION PREVENTION ARRANGEMENT FOR A BIMETAL IN A CIRCUIT BREAKER

FIELD OF THE INVENTION

The present invention relates generally to circuit breakers and, more particularly, relates to a reverse deflection prevention arrangement for a bimetal in a circuit breaker.

BACKGROUND OF THE INVENTION

Use of circuit breakers is widespread in modern-day residential, commercial and industrial electric systems, and they constitute an indispensable component of such systems toward providing protection against over-current conditions. Various circuit breaker mechanisms have evolved and have been perfected over time on the basis of application-specific factors such as current capacity, response time, and the type of reset (manual or remote) function desired of the circuit breaker.

One type of circuit breaker mechanism employs a thermo-magnetic tripping device to "trip" a latch in response to a specific range of over-current conditions. The tripping action is caused by a significant deflection in a bimetal element which responds to changes in temperature due to resistance heating caused by flow of the circuit's electric current through the bimetal. The bimetal element is typically in the form of a blade and operates in conjunction with a latch so that blade deflection releases the latch after a time delay corresponding to a predetermined over-current threshold in order to "break" the current circuit associated therewith. Additionally, circuit breaker mechanisms of this type often include an electromagnet arrangement which includes a yoke and armature which are attracted to each other to release the latch in the presence of a very high current or short circuit condition.

Occasionally, bimetals used in this type of circuit breaker would be over heated and deflect in the direction of their normal thermal deflection to a position where they became permanently deformed and would not deflect back to their original shape. To overcome this problem, a stop member was placed on the circuit breaker base to prevent the bimetals from deflecting in the direction of their normal thermal deflection to a position past the point where they were permanently deformed.

However, a problem exists in some circuit breakers during very high current short circuit testing. During these tests, high magnetic repulsive forces cause the bimetal to be repelled away from a current carrying terminal and deflected in a direction opposite its normal thermal deflection, or reverse deflection. This reverse deflection causes the bimetal to be permanently deformed, which renders the circuit breaker inoperative because the bimetal can no longer deflect the distance required to release the latch.

An additional problem exists in circuit breakers that operate in ambient temperatures below room temperature, or 24° C. When the ambient temperature drops below 24° C., the bimetal deflects in the direction opposite its normal thermal deflection. If the ambient temperature drops far enough below 24° C., the latch may not be released in the presence of a short circuit condition.

Accordingly, there is a distinct need for an improved circuit breaker which avoids the aforementioned shortcomings. According to the present invention, a novel reverse deflection prevention arrangement is provided for preventing the bimetal from deflecting in the direction opposite its normal thermal deflection.

SUMMARY OF THE INVENTION

An object of the present invention is to provide an arrangement for a circuit breaker which minimizes the amount of reverse deflection that the bimetal is forced to endure during high short circuit current interrupting tests.

The foregoing object is realized by providing a unique reverse deflection prevention arrangement for use in a circuit breaker for preventing a bimetal from bending in the direction opposite its normal thermal deflection. The reverse deflection prevention arrangement includes a tab portion extending from a yoke and a corresponding block member disposed on the inside surface of a circuit breaker cover.

The tab portion engages the block member when the bimetal is forced to deflect in a direction opposite its normal deflection.

According to another embodiment of the present invention, the reverse deflection prevention arrangement includes a reinforcement member secured to one end of the bimetal. The reinforcement member strengthens and supports the bimetal so that it is prevented from bending in the direction opposite its normal thermal deflection.

BRIEF DESCRIPTION OF THE DRAWINGS

Other objects and advantages of the present invention will become apparent upon reading the following detailed description and upon reference to the drawings in which.

Figure 1:
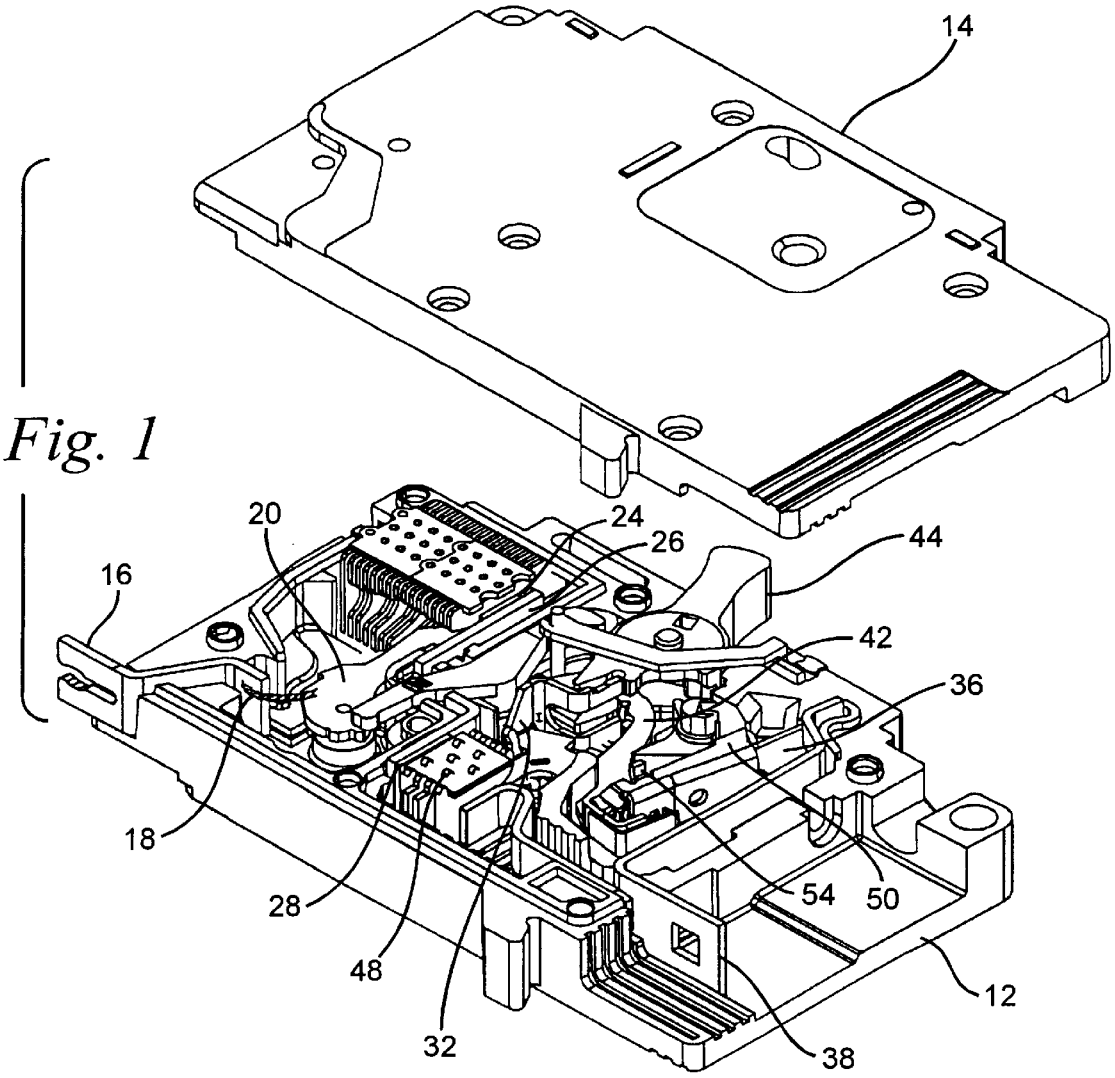
FIG. 1 is a perspective view of a circuit breaker including a yoke stop arrangement embodying the present invention.

While the invention is susceptible to various modifications and alternative forms, a specific embodiment thereof has been shown by way of example in the drawings and will be described in detail. It should be understood, however, that it is not intended to limit the invention to the particular form described. On the contrary, the intention is to cover all modifications, equivalents and alternatives falling within the spirit and scope of the invention as defined by the appended claims.

DESCRIPTION OF THE PREFERRED EMBODIMENTS

Figure 3:
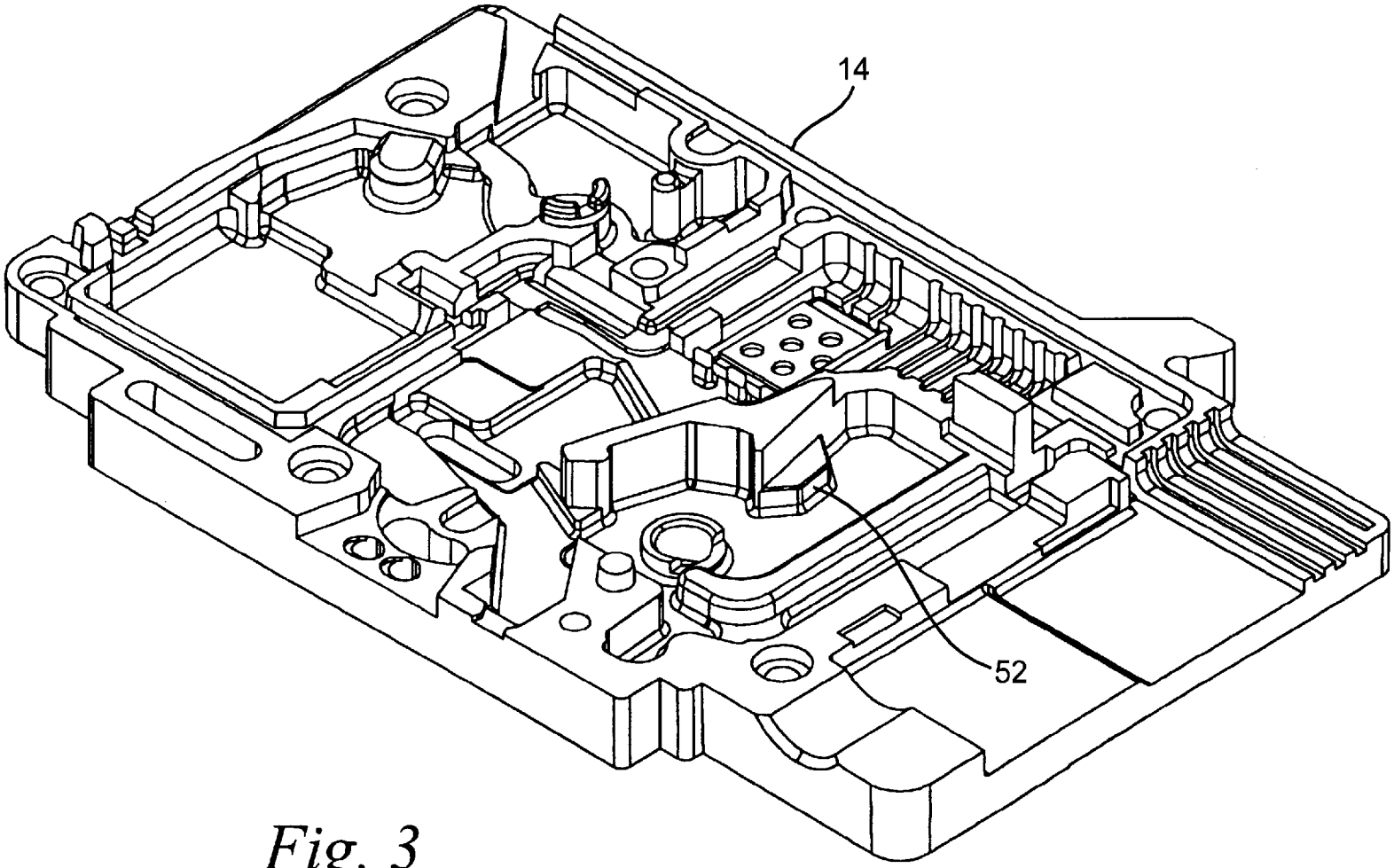
FIG. 3 is a perspective view of a cover embodying the present invention and which may be used on the circuit breaker of FIG. 1.

Turning now to the drawings, FIGS. 1 & 3 illustrate a circuit breaker having a novel reverse deflection prevention arrangement embodying the principles of the present invention for preventing a bimetal from bending in the direction opposite its normal thermal deflection. The reverse deflection prevention arrangement will be described in detail below following a brief description of the overall operation of the exemplary circuit breaker.

Figure 2:
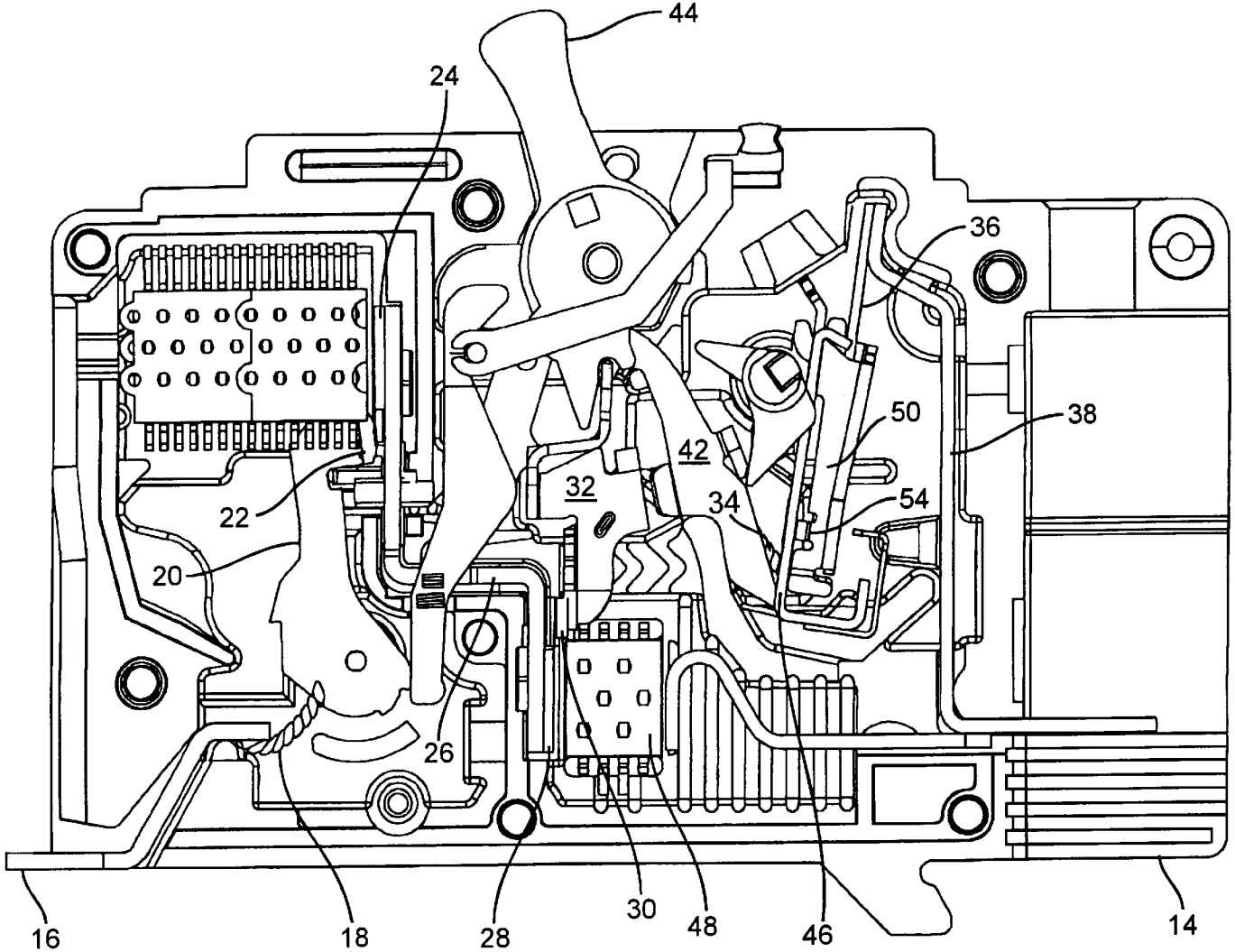
FIG. 2 is a side view of the circuit breaker shown in FIG. 1.

As shown in FIGS. 1 & 2, the circuit breaker includes a base 12 and a corresponding cover 14. The base 12 carries all of the internal components of the circuit breaker. The current path through the circuit breaker begins at a line terminal 16, and from the line terminal 16 the current path goes through a flexible pigtail 18. The flexible pigtail 18 is attached to a secondary blade 20 having a moveable contact 22 (shown in FIG. 2) mating with a stationary contact 24. Current flows through the moveable and stationary contacts 22, 24 to a mid terminal 26, which is configured in an S form. The other side of the mid terminal 26 includes another stationary contact 28 connected thereto. Positioned opposite the stationary contact 28 is a mating moveable contact 30 (shown in FIG. 2) attached to a primary blade 32. Current flows through the stationary and moveable contacts 28, 30, through the primary blade 32, and into one end of a primary flexible connector or pigtail 34 (shown in FIG. 2). The other end of the primary flexible connector 34 is attached to a bimetal 36, which provides the thermal tripping characteristics for the circuit breaker. Finally, the current flows from the bimetal 36 through a load terminal 38 and out of the load end of the circuit breaker.

The circuit breaker also includes a trip lever 42, a handle 44, a magnetic armature 46 (shown in FIG. 2), a primary arc stack 48 and a yoke 50. These components are used to implement the manual ON/OFF operation, the thermal-trip separation, and the electromagnetic trip separation of the primary contacts 28 and 30.

For further information regarding the overall construction and operation of the circuit breaker shown in FIG. 1, reference may be made to circuit breakers having similar construction which are disclosed in U.S. Pat. Nos. 5,680,081, 5,430,419, 5,498,847, and 5,428,328 which are assigned to the instant assignee and incorporated herein by reference.

Normal ON and OFF operation of the primary blade 32 occurs in response to rotation of the handle 44 in a clockwise or counterclockwise motion. In response to rotation of the handle 44 in either direction, the primary blade 32 either opens or closes the circuit via the primary moveable contact 30 and the primary stationary contact 28.

The illustrated circuit breaker utilizes conventional magnetic and thermal trip protection features to interrupt overload and short circuit current conditions. The circuit breaker is ready to be tripped when the trip lever 42 is engaged or latched in an aperture (not shown) in the armature 46. In response to a predetermined short circuit current flowing through the bimetal 36, the magnetic armature 46 is drawn a predetermined distance toward the yoke 50. This allows the trip lever 42 to disengage from the magnetic armature 46 and rotate in the clockwise direction, which, in turn, allows the primary blade 32 to rotate in the counterclockwise direction to the tripped position. This results in the primary blade contact 30 separating from the stationary contact 28 and interrupting the current flow. In response to a predetermined overload current flowing through the current path, the bimetal member 36 heats up and deflects in the counterclockwise direction to allow the trip lever 42 to disengage from the magnetic armature 46 followed by the same sequence of events as discussed above resulting in the primary blade contact 30 separating from the stationary contact 28. Related tripping arrangements are shown in U.S. Pat. Nos. 2,902,560, 3,098,136, 4,616,199, 4,616,200, and 5,245,302, each of which is assigned to the instant assignee and incorporated herein by reference.

Figure 5:
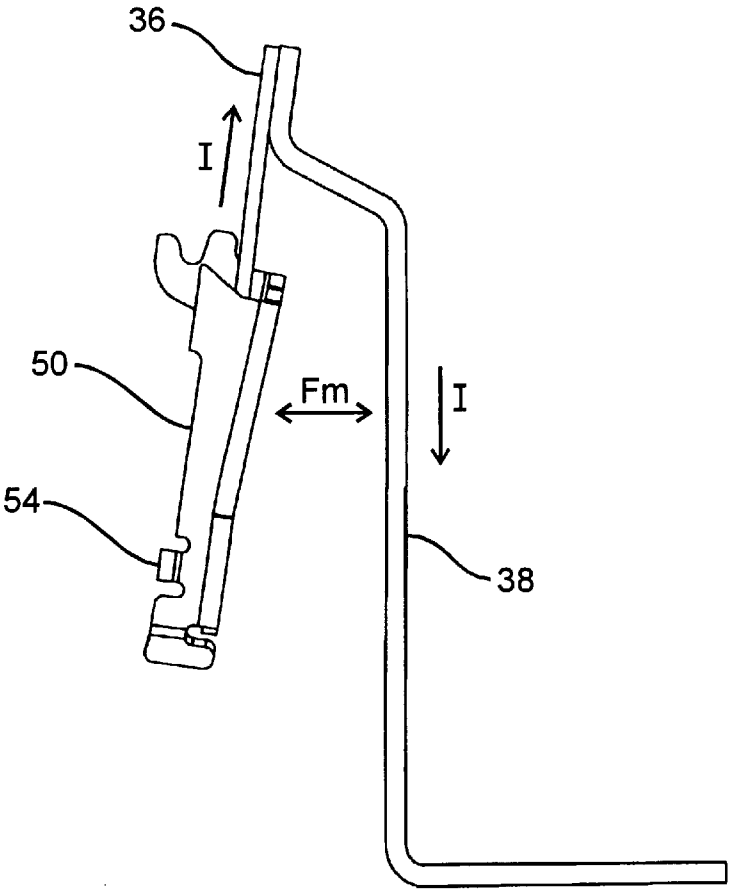
FIG. 5 is a side view of the bimetal terminal assembly shown in FIG. 4.
Figure 4:
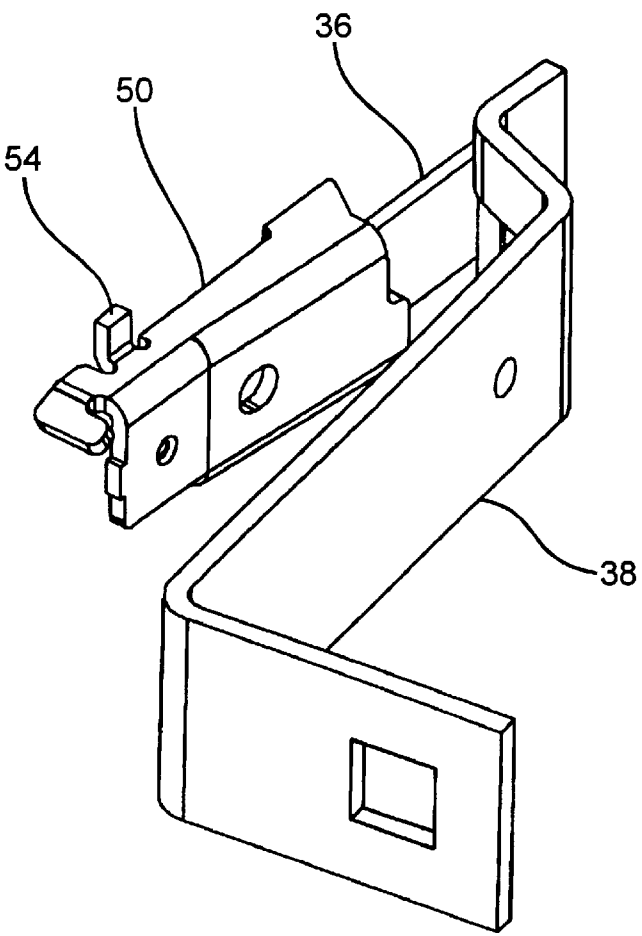
FIG. 4 is a perspective view of a bimetal terminal assembly embodying the present invention and which may be used in the circuit breaker of FIG. 1.

FIGS. 4 and 5 illustrate a more detailed view of a bimetal terminal assembly including the yoke 50, bimetal 36 and load terminal 38. The bimetal 36 is welded to the line terminal and the yoke 50 is welded to the bimetal 36.

Figure 7:
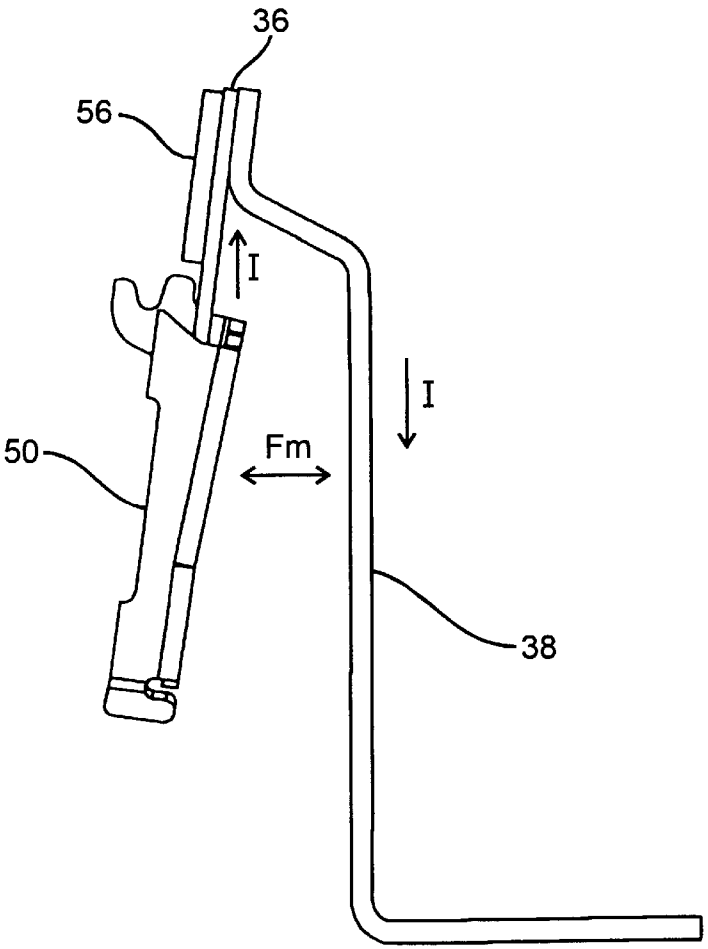
FIG. 7 is a side view of the bimetal terminal assembly shown in FIG. 6.

To be certified with Underwriters Laboratories Inc., circuit breakers must undergo and pass several tests. One of these tests requires the circuit breaker to interrupt a very high short circuit current condition and then must be capable of operating normally by interrupting normal overload current conditions thereafter. As illustrated in FIGS. 5 & 7, current flows through the bimetal 36 and the load terminal 38 in the direction of arrows I. The current flows through the bimetal 36 and load terminal 38 in opposite directions, thereby forming a magnetic repulsion force $F_m$ between the bimetal and load terminal due to oppositely disposed electromagnetic forces in them. Under normal operating conditions, the magnetic repulsion force $F_m$ does not cause a problem. However, when the current in the current path approaches the levels existing during the very high short circuit current tests, the magnetic repulsion force $F_m$ causes the bimetal to bend in the clockwise direction, in the direction opposite of its normal thermal deflection, or reverse deflection.

Bimetals are designed so that they will deflect in a normal thermal deflection direction in response to heat generated by current flowing therethrough and return to an original shape once the heat is dissipated. Bimetals can bend, for a short distance, in the direction opposite of this normal thermal deflection without damage; however, if they are bent past a predetermined yield point, they will not return to their original shape. During the aforementioned very high short circuit current tests, the magnetic repulsion force $F_m$ causes the bimetal to bend past its yield point, thus permanently deforming the bimetal and rendering the circuit breaker inoperative. This problem is solved by the novel reverse deflection prevention arrangement whereby the bimetal is prevented from bending past its yield point.

FIGS. 3, 4 and 5 show a preferred embodiment of the reverse deflection prevention arrangement. As shown, the reverse deflection prevention arrangement is provided including a block member 52 (FIG. 3) molded onto the inside of the cover 14 and a tab portion 54 (FIGS. 4 & 5) extending from the yoke 50. The block member 52 and tab portion 54 are correspondingly located so that the tab portion cooperatively engages the block member when the magnetic repulsion force $F_m$ attempts to bend the bimetal 36 in the direction opposite its normal thermal deflection direction. Thus, preventing the bimetal from becoming permanently deformed during very high short circuit current conditions.

This novel reverse deflection prevention arrangement also provides the advantage of allowing the circuit breaker to operate more efficiently when operating temperatures of the circuit breaker are below room temperature, or 24° C. In a traditional circuit breaker, when the operating temperature drops below 24° C., the bimetal deflects in the direction opposite its normal thermal deflection. As the operating temperature decreases further below 24° C., the bimetal may eventually deflect into a position that causes the trip lever to be positioned too far into the armature. In this position, it is difficult for the trip lever to disengage from the armature during short circuit conditions.

As stated above the reverse deflection prevention arrangement of the present invention prevents the bimetal from bending in the direction opposite its normal thermal deflection. For example, when the operating temperature drops below 24° C. and the bimetal 36 attempts to deflect in the direction opposite its normal thermal deflection, the tab portion 54 engages the block member 52 to prevent further reverse bending. Thus, keeping the trip lever 42 in the correct engagement position with the magnetic armature 46 thereby allowing the trip lever to disengage from the magnetic armature during a short circuit condition.

Figure 6:
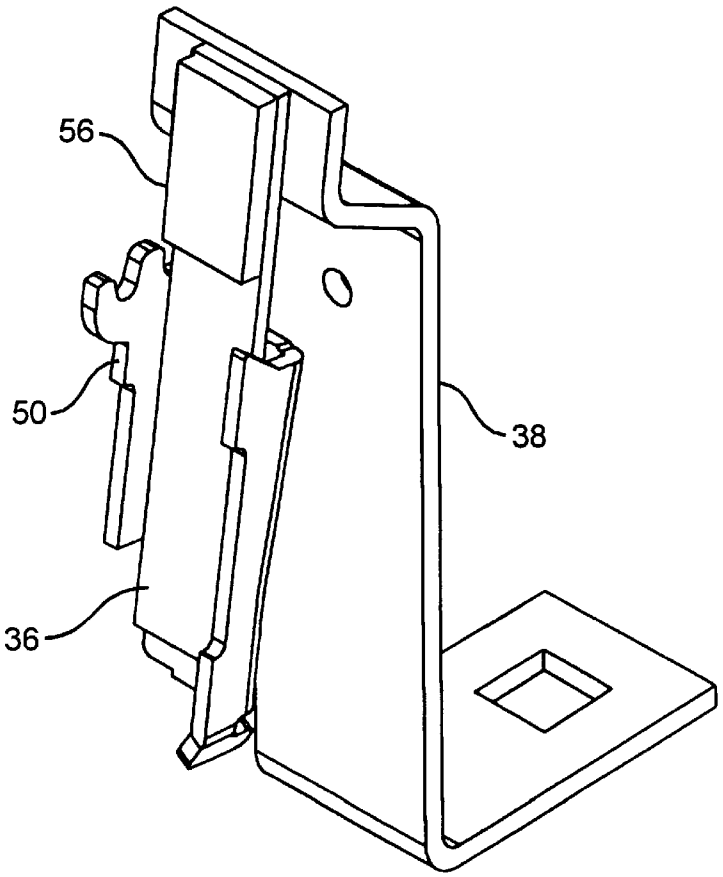
FIG. 6 is a perspective view of a bimetal terminal assembly embodying another embodiment of the present invention and which may be used in the circuit breaker of FIG. 1.

FIGS. 6 and 7 show a bimetal terminal assembly embodying an alternate solution for preventing the bimetal from bending in the direction opposite of its normal thermal deflection. This alternate embodiment of the reverse deflection prevention arrangement of the present invention prevents the bimetal from deflecting in the direction opposite its normal thermal deflection; however, it is not as effective as the previously described preferred embodiment. The reverse deflection prevention arrangement of the alternate embodiment of the present invention is shown having a reinforcement member or plate 56 welded to the bimetal 36. The plate 56 is located at the end of the bimetal 36 where it bends in response to the magnetic repulsion force $F_m$. At this location, the plate 56 reinforces and supports the bimetal thereby preventing it from bending in the direction opposite its normal thermal deflection so that it can withstand the magnetic repulsion force $F_m$ without becoming permanently deformed. Additionally, the plate 56 supports the bimetal to prevent it from bending in the direction opposite its normal thermal deflection when the operating temperature drops below 24° C.

Those skilled in the art will readily recognize that various modifications and changes may be made to the present invention without departing from the true spirit and scope thereof, which is set forth in the following claims. For example, the tab portion may be disposed on the bimetal rather than the yoke and the block member may be located on the base rather than the cover.

What is claimed is:

1. A circuit breaker having a bimetal for initiating interruption of a current path, wherein certain electromagnetic forces can cause the bimetal to deflect in a direction opposite its normal thermal deflection, the circuit breaker comprising:

a base;

a cover disposed on the base;

a yoke disposed on the bimetal;

the bimetal having one end rigidly connected to the line terminal and the opposing end rigidly connected to the yoke, the yoke extending along the length of the bimetal from the opposing end to at least the midpoint of the bimetal; and reverse deflection prevention means for preventing the bimetal from deflecting in the direction opposite its normal thermal deflection when the electromagnetic forces force the bimetal to deflect in the direction opposite its normal thermal deflection, the reverse deflection means including:

a stop member formed on the cover; and a tab member rigidly connected to and extending outwardly from a side of the yoke cooperatively corresponding to the stop member, the tab member engageble with the stop member for preventing the bimetal from deflecting in the direction opposite its normal thermal deflection.

2. The circuit breaker according to claim 1, wherein the reverse deflection prevention means further includes a reinforcement member secured to the bimetal.

3. A reverse deflection prevention arrangement for preventing a bimetal from bending in a direction opposite its normal thermal deflection in a circuit breaker having a cover disposed on a base and a yoke secured to the bimetal, the reverse deflection prevention arrangement comprising:

the bimetal having one end rigidly connected to the line terminal and the opposing end rigidly connected to the yoke, the yoke extending along the length of the bimetal from the opposing end to at least the midpoint of the bimetal;

a stop member formed on the cover; and a tab member extending from the yoke cooperatively corresponding to the stop member, the tab member engageble with the stop member when magnetic repulsive forces force the bimetal to deflect in the direction opposite its normal thermal deflection direction for preventing the bimetal from deflecting in the direction opposite its normal deflection direction.

4. A circuit breaker comprising:

a base and cover;

a stationary contact disposed in the base;

a blade disposed in the base;

a movable contact disposed on the blade and movable into and out of engagement with the stationary contact;

a releasably latchable trip lever pivotally mounted in the base and releasable from a latched position for movement to a tripped position to effect separation of the stationary and movable contacts;

a bimetal disposed in the base for causing the release of the trip lever from the latched position, the bimetal having a normal direction of thermal deflection and an opposite direction of thermal deflection, the bimetal having one end rigidly connected to the line terminal, the connection being made along one face;

a yoke secured to the bimetal; and reverse deflection prevention means for preventing the bimetal from bending in a direction opposite its normal thermal deflection, the reverse deflection means including a reinforcement member rigidly secured to the same end of the bimetal as the line terminal for preventing the bimetal from being deflected in a direction opposite its normal thermal deflection in response to a magnetic repulsive force generated between the load terminal and the bimetal, the reinforcement member rigidly secured to the face of the bimetal opposing the line terminal and extending along the length of the bimetal substantially beyond the length connecting the bimetal end to the line terminal.

5. The circuit breaker according to claim 4, wherein the reverse deflection prevention means further includes:

a stop member formed on the cover; and a tab member rigidly connected to and extending outwardly from a side of the yoke cooperatively corresponding to the stop member, the tab member engageble with the stop member for preventing the bimetal from deflecting in the direction opposite its normal thermal direction.

6. A circuit breaker having a base and a cover with the base carrying a line terminal and a load terminal which are electrically connected through an electrical circuit extending therebetween, the circuit breaker comprising:

a first contact;

a second contact;

a blade carrying the second contact and movable between (i) a first position wherein the second contact is engaged with the first contact and corresponding to a closed electrical circuit condition between the line terminal and the load terminal and (ii) a second position wherein the second contact is spaced away from the first contact and corresponding to an open electrical circuit condition wherein said electrical circuit is not completed between the line terminal and the load terminal;

current responsive means including an armature and a bimetal and yoke assembly for sensing a predetermined overcurrent or short circuit condition in the electrical circuit and for moving the armature a predetermined distance in response thereto;

trip means associated with the current responsive means for moving the contact carrier from the first position to the second position in response to the movement of the armature the predetermined distance; and a reverse deflection prevention arrangement for preventing the bimetal from being deflected in a direction opposite its normal thermal deflection in response to a magnetic repulsive force generated between the load terminal and the bimetal, the reverse deflection prevention arrangement including:

the bimetal having one end rigidly connected to the line terminal and the opposing end rigidly connected to the yoke, the yoke extending along the length of the bimetal from the opposing end to at least the midpoint of the bimetal;

a stop member formed on the cover; and a tab member rigidly connected to and extending outwardly from a side of the yoke cooperatively corresponding to the stop member, the tab member engageable with the stop member for preventing the bimetal from deflecting in the direction opposite its normal deflection direction.

7. A circuit breaker having a base and a cover with the base carrying a line terminal and a load terminal which are electrically connected through an electrical circuit extending therebetween, the circuit breaker comprising:

a first contact;

a second contact;

a blade carrying the second contact and movable between (i) a first position wherein the second contact is engaged with the first contact and corresponding to a closed electrical circuit condition between the line terminal and the load terminal and (ii) a second position wherein the second contact is spaced away from the first contact and corresponding to an open electrical circuit condition wherein said electrical circuit is not completed between the line terminal and the load terminal;

current responsive means including an armature and a bimetal and yoke assembly for sensing a predetermined overcurrent or short circuit condition in the electrical circuit and for moving the armature a predetermined distance in response thereto;

trip means associated with the current responsive means for moving the contact carrier from the first position to the second position in response to the movement of the armature the predetermined distance;

the bimetal having one end rigidly connected to the line terminal, the connection being made along one face;

and a reinforcement member rigidly secured to the same end of the bimetal as the line terminal for preventing the bimetal from being deflected in a direction opposite its normal thermal deflection in response to a magnetic repulsive force generated between the load terminal and the bimetal, the reinforcement member rigidly secured to the face of the bimetal opposing the line terminal and extending along the length of the bimetal substantially beyond the length connecting the bimetal end to the line terminal.

* * * * *